United States Patent [19]

Dicken, Jr. et al.

[11] 4,210,285

[45] Jul. 1, 1980

[54] DISHWASHER HAVING IMPROVED SPRAY ARM

[75] Inventors: John A. Dicken, Jr.; David B. Ash, both of Louisville, Ky.

[73] Assignee: General Electric Company, Louisville, Ky.

[21] Appl. No.: 861,317

[22] Filed: Dec. 16, 1977

[51] Int. Cl.[2] ..... B05B 3/06

[52] U.S. Cl. ..... 239/251

[58] Field of Search ..... 239/110, 246–249, 239/251–262, 553; 134/176, 179

[56] References Cited

U.S. PATENT DOCUMENTS

| | | | |
|---|---|---|---|
| 1,737,257 | 11/1929 | Merseles | 239/246 X |
| 2,905,393 | 9/1959 | Federighi et al. | 239/110 |
| 3,447,752 | 6/1969 | Hardy | 239/251 |
| 3,809,106 | 5/1974 | Crabtree | 134/176 |

*Primary Examiner*—Robert B. Reeves
*Assistant Examiner*—Gene A. Church
*Attorney, Agent, or Firm*—Bruce A. Yungman; Radford M. Reams

[57] ABSTRACT

A hollow elongated spray arm for transmitting washing liquid from a conduit leading from the pump, the arm having one or more radially extending projections having a plurality of spray orifices therein. The projections include a guide disposed adjacent at least one of the orifices for orienting relatively long slender foreign objects suspended in the washing liquid to insure that such objects can pass through the orifice for later automatic or manual removal from the machine. The orifice is preferably located at the terminus of at least one of the radial projections such that it intersects the end portion thereof.

6 Claims, 8 Drawing Figures

FIG. 1
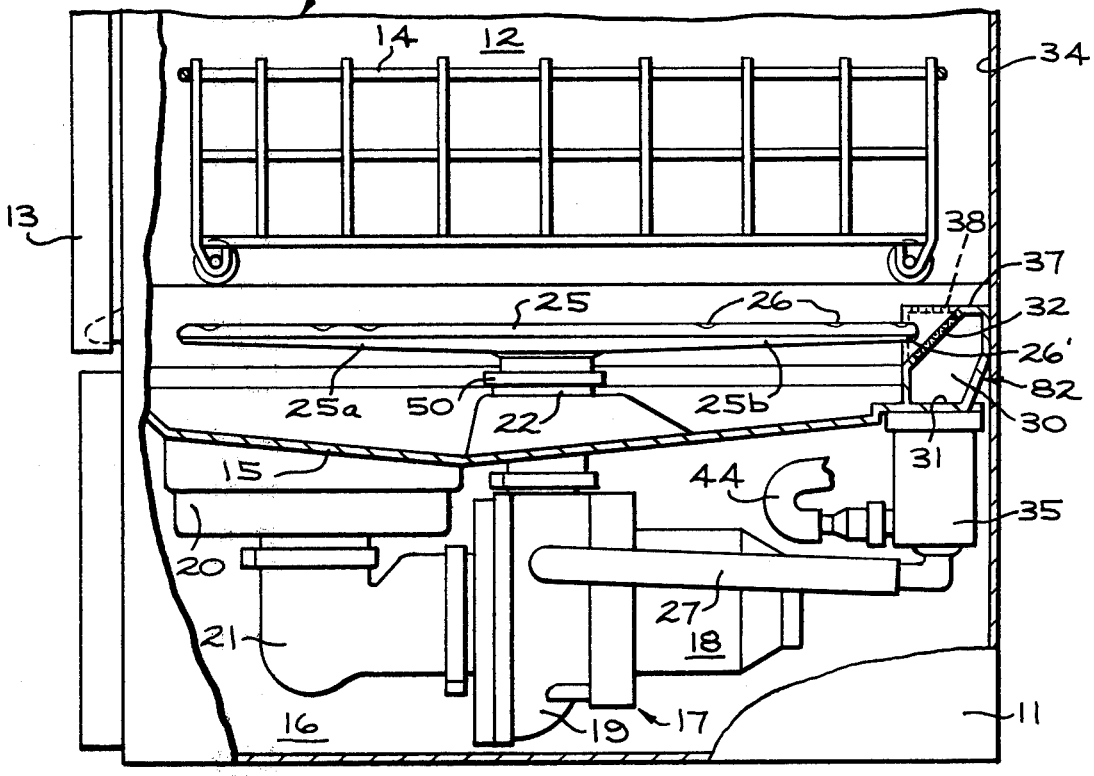
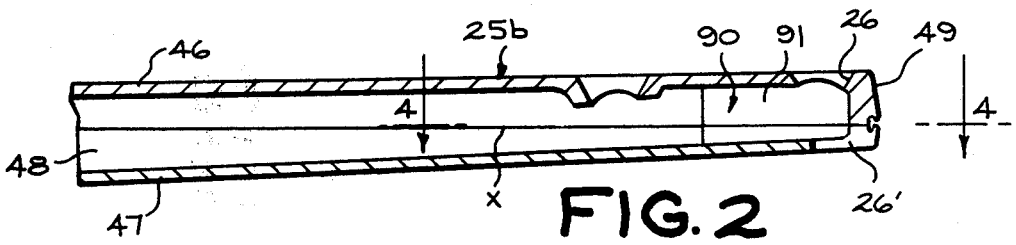
FIG. 2
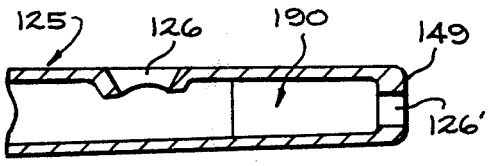
FIG. 3
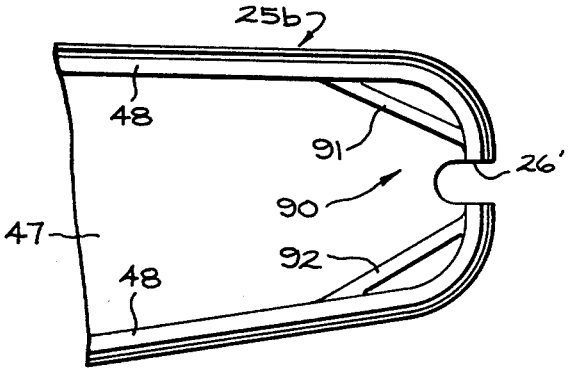
FIG. 4
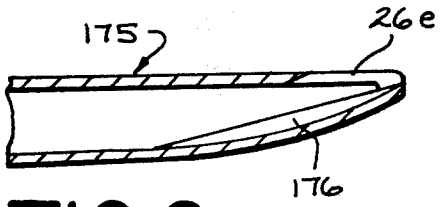
FIG. 8

DISHWASHER HAVING IMPROVED SPRAY ARM

BACKGROUND OF THE INVENTION

This invention relates to dishwashing machines of the type used in households and small restaurants having upper and lower racks within which are arranged articles to be washed. Ordinarily the lower rack is loaded with larger size plates, pots and pans, and the like, and the upper rack is particularly designed to carry the smaller dishes, cups and glassware. Such dishwashing machines normally have one or more spray arms which rotate on a horizontal plane having orifices or jets which spray the washing and rinsing liquid upwardly and/or downwardly against the dishes in the racks thereabove or therebelow depending on the location of the arm itself. One or more of these orifices or jets may be positioned so that the water streams issuing therefrom cause the spray arm itself to rotate thereby achieving maximum coverage of the dishes by the washing liquid.

One of the problems associated with these hollow elongated spray arms has been the blockage of the spray orifices or nozzles with long slender objects such as toothpicks, matches, pieces of bone, plastic and other debris which is washed from the dishes placed within the washer. When these orifices become clogged or blocked the effectiveness of the spray arm is reduced. In most cases the spray arms are not capable of being disassembled so as to remove any debris which may be trapped therein.

SUMMARY OF THE INVENTION

It is therefore the primary object of this invention to provide an improved spray arm for an automatic dishwasher having guide means in association with one or more of the spray nozzles contained in the spray arm which straighten such large slenderness ratio objects and channel said objects to the orifices for ejection therefrom.

The present invention may be summarized as relating to an automatic dishwashing machine of the type having a washing chamber and means therewith for providing washing liquid in the washing chamber and accumulating it at a relatively low level therein. The washing machines include at least one spray arm for circulating the flow of washing liquid generally throughout the washing chamber, and a drain sump is provided in the bottom wall of the chamber for supplying liquid to the spray arm and for conducting soil-laden washing liquid or effluent out of the machine. The spray arm receives washing liquid through a conduit connected to the pump and rotates in response to the fluid directed from one or more reaction nozzles contained thereon. At least one orifice is formed in the spray arm preferably adjacent one of its terminal ends. A generally V-shaped channel is disposed adjacnet the orifice and extends inwardly and divergently from the orifice. As any elongated debris comes in contact with the channel, the channel straightens the object and guides it in the direction of the orifice for ejection therefrom.

BRIEF DESCRIPTION OF THE DRAWING

FIG. 1 is a side elevational cut away view of the bottom portion of a domestic dishwashing machine in accordance with the present invention.

FIGS. 2, 3 and 8 are fragmentary elevational views of three alternate spray arms made according to the present invention.

FIG. 4 is a fragmentary plan view taken along the line 4—4 of FIG. 2.

DETAILED DESCRIPTION OF THE PREFERRED EMBODIMENT

Figure 5:
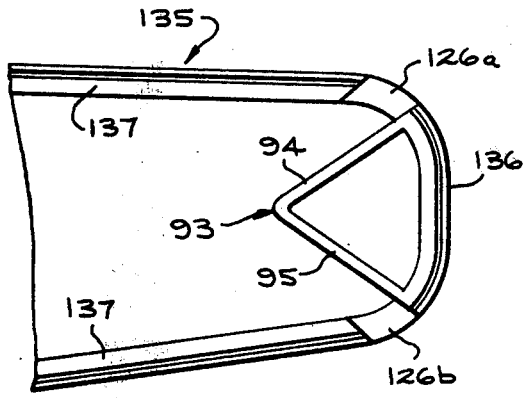
FIGS. 5, 6 and 7 are plan views of alternate embodiments of spray arms according to the present invention.

In FIG. 1 there is illustrated the lower portion of an automatic dishwashing machine 10 including a cabinet 11 defining therein a washing chamber 12. Access to the washing chamber or tub 12 is obtained by opening a door 13 pivoted at its lower end and located on the front side of the cabinet 11. A dish rack 14 is shown supported for slidable movement within the washing chamber 12 so that it may be selectively slid outwardly through the cabinet's front access opening to facilitate loading and unloading of the items to be washed in the machine 10. The lower end of the washing chamber 12 is defined by a bottom wall or floor portion 15 that separates it from a lower motor-pump compartment 16. Housed within the compartment 16 is a motor-pump assembly 17 including an electric motor 18 that drives a pump means 19 for recirculating washing liquid to and from the washing chamber 12 and for draining washing liquid from the washing chamber 12 outwardly to the household sewage system. The operational cycle of such a machine generally includes a number of washing and rinsing steps and a final drying step. In a dishwasher machine, such as that shown in FIG. 1, heated water from the household supply line is directed into the washing chamber 12 by valve means actuated by a timer control (not shown). The water accumulates to a predetermined level on the floor portion 15 and then the timer control of the machine causes the electric motor 18 to be energized to drive the pump 19 in a recirculation operation. This method of fill is called the "static" method. A dynamic fill is also used whereby the motor is energized and the pump goes into the recirculation mode during the time-controlled fill period. In the recirculation operation the accumulated washing liquid is drained out of the washing chamber 12 by means of a sump 20 emptying into a conduit 21 leading to the pump 19. The liquid is then forced upwardly by the pump 19 through a conduit 22 leading to a hollow horizontally elongated spray arm 25 located within the lower portion of the washing chamber 12.

Generally, clean water is introduced into the machine for each wash step and again for each rinse step, and detergent is added, by automatic means (not shown), for the wash step. The term "washing liquid" is therefore used herein in a generic sense to refer broadly to any form of cleansing liquid utilized for recirculation within the dishwashing machine. The washing liquid is distributed from the spray arm 25 by means of orifices 26 spaced therealong. The spray arm 25 is reactively driven by having at least one of the orifices disposed to discharge a jet stream in a direction such that the spray arm reacts to the force of the discharge and rotates in a horizontal plane. A thorough and generally uniform distribution of washing liquid in the washing chamber 12 is thereby obtained. Recirculation of the washing liquid from the washing chamber 12, through the pump 19 and, thence through the spray arm 25, is continued for a predetermined length of time after which the electrical circuit to a drain valve means (not shown) causes the valve to automatically switch an outlet within the pump means 19 so that recirculation ceases and the pump 19 begins to discharge the washing liquid from the washing chamber outwardly through a drain hose 27 leading ultimately to the household sewage system.

Shown in FIG. 1 is a soil-removal means 82 in the form of a receptacle 30 having a trough 31 disposed in the path of recirculation of liquid within the washing chamber 12 and adapted to fill and overflow with the recirculated liquid caught therein. The soil-removal means further includes the filtering means 32 contiguous to the trough 31 and disposed in the path of the liquid flow whereby liquid from the receptacle passes through the screen while soil particles carried in the washing liquid are blocked from passage and therefore halt against the back or upstream side of the screen. The trough 31 may be transversely elongated to extend across the substantially entire back wall 34 of chamber 12. In addition to the trough 31, the receptacle 30 further comprises a lower end portion in the form of a tubular box or hopper 35. The trough 31 has a configuration such that liquid and soil particles collected therein will flow centrally downwardly through an opening (not shown) into the hopper 35. The filtering screen 32 is disposed at approximately a 45° angle with reference to the back wall 34 of the wash chamber 12, and the upper long edge of the filtering screen 32 abuts against the forward edge of a horizontally disposed perforated cover plate 37. The cover plate 37 is disposed across the trough's opening and is provided with a uniform arrangement of apertures 38 equidistantly spaced thereacross.

For more detailed illustration and description of the soil-removing means 82 reference may be made to commonly-assigned U.S. Pat. No. 3,807,419, and specifically FIGS. 2–4 thereof.

The spray arm 25 is rotatably positioned within the diswashing chamber 12. The spray arm 25 has one or more radially extending projections **25*a* and 25*b*. Arm 25 is journalled to a tubular bearing portion 50, which cooperates with the water discharge pipe or conduit 22, to permit rotation thereof. As can be seen in FIG. 1, conduit 22 projects through and is fastened to the bottom portion 15 of the dishwasher tub. The bearing member 50 includes a rubber seal to prevent leakage of water therefrom and is of a configuration well known to those skilled in the art. For more detailed description of the bearing member 50, reference may be made to U.S. Pat. No. 3,969,137 or 3,866,837 issued to the assignee hereof. These patents also illustrate alternate spraying devices having a spray arm combined with a "spray tower" projecting from the discharge conduit 22 which devices could have equal application with the invention disclosed herein. Referring more specifically to FIG. 2, a fragmentary section of spray arm 25 is shown in more detail. A plurality of spray orifices or nozzles 26 are formed in the top half of the projection 25*b*, one or more being at or near the radially terminal end thereof. Orifice 26' is formed at the bottom terminal end. Orifice 26' may be utilized to bachwash the filter 32 of the soil-removal means 82 as is more fully described in copending patent application (9DDW-10516) assigned to the assignee hereof. The spray arm 25 may be fabricated from any type of material including polypropylene, and is normally fabricated in two halves as can be seen by the parting line X. The projection 25*b* comprises a top portion 46 and a bottom portion 47 which extend relatively parallel in a horizontal plane, and having side walls 48 defining a passageway and an end section 49. The top portion 46 normally contains the spray orifices and the bottom portion 47 is journalled to the bearing member 50 for rotation about the conduit 22**.

Referring more specifically to FIGS. 2 and 4, the guide means 90 is shown in detail. The guide means comprises one or more wall members disposed within the projection **25*b* and adjacent at least one of the orifices 26, preferably an orifice disposed at the radially terminal end 49 of projection 25*b* such as orifice 26' which intersects both the bottom 47 and end 49 of arm 25. If the spray arm 25 is fabricated from a polypropylene or other plastic material the guide means may be formed integrally with the top and bottom sections 46 and 47 respectively and will meet at the parting line X shown in FIG. 2 when assembled. Otherwise the wall members may be formed from metal or other material and fastened to the spray arm 25 in any conventional manner such as welding. Referring to FIG. 4, the guide means is shown as two wall sections or vanes 91 and 92 which are disposed relatively near the opening of spray orifice 26' and extend radially inwardly of the projection 25*b* in a divergent or generally obliquely angled manner until they meet the side walls 25*c* of the projection. A V-shaped channel is thus formed within the projection 25*b*. Note that in those cases where the spray arm is fabricated from a plastic material the guide means 90** also serves as a strengthening support.

Referring to FIG. 3, an alternate spray arm 125 is illustrated which utilizes the guid means 190 similar to the guide means 90 of spray arm 25 described above. In this embodiment however, the orifice 126 is contained completely within the end section 149 of the spray arm 125. A plan view of this arm would be substantially identical to that of FIG. 4.

Referring to FIG. 5 another alternate embodiment of the invention is shown. In this embodiment the V-shaped guide means 93 is inverted with the vertex facing radially inwardly and centrally of the projection 135 having divergent walls 94 and 95 which connect to the terminal end 136 of the projection radially outwardly and adjacent to two orifices **126*a* and 126*b* formed therein. In this embodiment the orifices 126*a* and 126*b* and formed substantially through the side walls 137 of the projection 135 although it should be appreciated that the orifices could be formed in the end section 136** of the spray arm projection as well.

Figure 6:
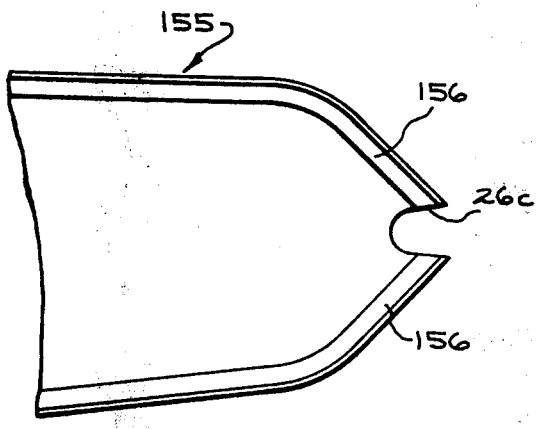
Figure 7:
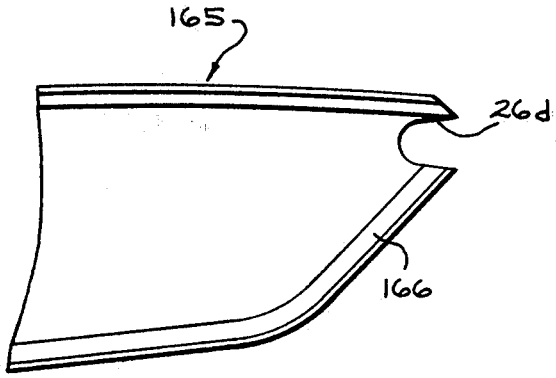

The spray arms 155 and 165 of FIGS. 6 and 7 respectively illustrate other alternative embodiments of the invention. In these two embodiments the guide means is the bent or specially formed side walls 156 of arm 155 and 166 of arm 165. That is, the need for additional alignment "vanes" is unnecessary, since the side wall section will guide elongated debris through the orifices **26*c* and 26*d*. The spray arm 175 of FIG. 8 illustrates still another variation according to the invention wherein the bottom 176 of the arms serves as a dish-shaped ramp for guiding debris through orifice as outlet 26*c***.

In the operation of the dishwasher 10 shown in FIG. 1, the washing step of the operational cycle commences with the introduction of water to the washing chamber 12 whereby water accumulates on the floor portion 15 to a maximum level below the under surface of the spray arm 25 and below the bottom-most portion of screen 32. Detergent is automatically added to the water and the resultant washing liquid is caused to follow a circular path down the sump 20 and through the conduit 21 to the pump 19. As heretofore described, motor 18 causes the pump 19 to force the washing liquid upwardly and outwardly through the hollow spray arm 25. The spray arm 25 rotates in response to a jet stream discharged from at least one end thereof and the orifices 26 discharge streams of washing liquid upwardly over items stored in the rack 14 and generally over additional items in one or more other vertically spaced racks (not shown). The cascade of washing liquid distributed through the washing chamber 12 tends to progress downwardly over the items in the rack but primarily down along the inside surface of the door 13, the side walls of the wash chamber 12 and the back wall 34. Therefore, the back wall 34 serves as a shedding surface for directing recirculated washing liquid downwardly against the cover plate 37 of the bypass filter 82.

As the washing step (or rinsing step) progresses for its predetermined time, the soil-laden washing liquid flows downwardly repeatedly along the washing chamber back wall 34 toward the cover plate 37. Much of the washing liquid moves through the slots and the perforations 38 of the cover plate 37 and into the trough 31. Obviously, once the trough 31 is initially filled, it flows over its forward wall and outwardly through the filtering screen 32. The filtering screen 32 is preferably of a fine mesh whereby even very small food soil particles will be blocked from passage therethrough and retained by the back side of the filtering screen 32. The filtering screen 32 is disposed whereby washing liquid moving down behind the rack 14 and forward of the back wall 34 will strike against the outside surface of the screen. The force of the downwardly cascading washing liquid and the pressurized spray from a jet such as 26' (described more fully in commonly assigned copending application 9D-DW-10516) impinges against the outside surface of the screen 32 serving to jar soil loose from the back side of the screen 32 whereby it will continuously move away from the screen as it collects thereagainst to keep the screen open for passage of washing liquid therethrough. As quantities of soil particles retained in the trough 31 by the screen 32 increase and agglomerate, they tend to precipitate and settle downwardly into the tubular hopper 35 so that by the end of the wash step of the machine's operational cycle a high percentage of suspended soil particles have thus been removed from the recirculated washing liquid in the wash chamber 12 and collected in the hopper 35. At the end of the washing step, the timer-control means (not shown) energizes the drain valve means for a period to permit final drainage of liquid from the cleaned items in the chamber 12. After the drain valve is automatically moved from the first to the second position the pump 19 continues to receive the washing liquid from the chamber 12 through the sump 20 and the conduit 21 and will pump it outwardly through the drain line 27 to the lower end of the hopper 35. The drainage flow or effluent is pumped through the hopper and outwardly through a final discharge line 44 draining outwardly from the dishwasher 10. The final discharge line 44 on a permanently installed dishwasher would lead directly to the household sewage system. On a portable type of dishwashing machine the final discharge line 44 would be provided with an outer end disposed to dispense the effluent liquid into the kitchen sink.

In order to accomplish effective drainage of hopper 35 various mechanisms may be employed. Two such devices are shown and described in the above-mentioned commonly-assigned U.S. Pat. No. 3,807,419, and specifically FIGS. 4 and 5 thereof.

The foreign objects defined as having a "large slenderness ratio," that is, objects such as toothpicks, matches, pieces of bone, pieces of plastic, and other materials which are long but have a relatively thin cross section, are washed from the dishes or otherwise are deposited within the sump 20. The pump 19 will force such objects up through the conduit 22 and into the spray arm 25. As these items flow through the hollow internal section of the spray arm they will eventually come into contact with the guide means such as 90 of FIGS. 2 and 4 or more specifically the wall sections 91 and/or 92 of the guide means. As these objects come in contact with the wall sections and regardless of what position they are in upon initial contact, the wall will straighten or align them and the water pressure will move them toward the ejection orifice 26' where they will be ejected from the spray arm 25. The guides 190 and 93 of the alternate spray arms 125 and 135 shown in FIGS. 3 and 5, or the side walls or bottom of arms 155, 165 and 175 respectively will serve the same function as described above. That is, they will straighten out or orient the foreign objects for ejection from the orifices **26*a*** and/or 26*b*. It will be appreciated that only objects which have a cross sectional diameter less than the diameter or opening of the ejection orifices will pass therethrough. However, the orifices typically used in such spray arms are normally more than sufficiently sized for this purpose. One will appreciate that with the use of this invention such elongated foreign objects suspended in the washing liquid as described above will no longer block the spray opening, and other debris will not be allowed to accumulate on such devices to create even further blockage. The ejected objects will then be filtered from the liquid via the soil-removal means 82, or will accumulate on the bottom of the tub for later manual removal.

It should be apparent to those skilled in the art that the embodiments described heretofore are considered to be the presently preferred forms of this invention. In accordance with the Patent Statutes, changes may be made in the disclosed mechanism and in the manner in which it is used without actually departing from the true spirit and scope of this invention.

What is claimed is:

1. A spray assembly for an automatic dishwasher comprising conduit means for receiving pressurized washing liquid located centrally of the spray assembly;

a hollow elongated spray arm having at least one radially extending projection including upper and lower walls interconnected by side walls defining a passageway adapted to receive said liquid therein and rotate about said conduit means and an end section;

said projection having a plurality of orifices formed in said upper wall portion for distributing said liquid throughout the dishwasher, an opening in said projection being arranged to include at least a portion thereof in said end section being aligned with said passageway;

guide means disposed within said projection being positioned between said walls and extending radially from said conduit means to a position adjacent said opening, said guide means being dimensioned for directing elongated foreign objects having a cross-section smaller than the opening and a length greater than height of said passageway, said guide means being dimensioned to orient said objects such that the elongated dimension becomes aligned with said orifice for passing therethrough.

2. The spray assembly of claim 1 wherein said guide means comprises at least one elongated wall section forming a generally V-shaped channel, the vertex of said V section disposed adjacent said orifice.

3. The spray assembly of claim 2 wherein said projection has a bottom portion connected for rotation with said conduit means, a top portion wherein a plurality of said spray orifices are disposed side walls interconnecting said top and bottom portions and an end portion interconnecting said top, bottom and side walls.

4. The spray assembly of claim 3 wherein said guide means extends substantially perpendicular to the top and bottom portions of said projection.

5. A spray assembly for an automatic dishwasher comprising conduit means for receiving pressurized washing liquid located centrally of the spray assembly;

a hollow elongated spray arm having at least one radially extending projection adapted to receive said liquid therein and rotate about said conduit means;

said projection having a plurality of orifices formed therein for distributing said liquid throughout the dishwasher; and guide means disposed within said projection adjacent at least one of said orifices including wall means formed integrally with said projection, said wall means disposed adjacent said orifice and angled away from the orifice as the wall means proceed in a substantially radial direction away from said orifice, said guide means being capable of receiving elongated foreign objects having a cross-section smaller than the opening of said orifice, said guide means adapted to orient said objects such that the elongated dimension becomes aligned with said orifice for passing therethrough.

6. The spray assembly of claim 5 wherein said projection includes a terminal end and wherein said guide means comprises divergent walls formed integrally with said projection, joined to form a vertex facing radially inwardly and generally centrally of said projection, each of said walls projecting radially outwardly to join the terminal end of said projection adjacent one of said orifices.

* * * * *